US006890166B2

(12) United States Patent
Kirchhoff

(10) Patent No.: US 6,890,166 B2
(45) Date of Patent: May 10, 2005

(54) SPINNING-DRAWING-TEXTURING MACHINE

(75) Inventor: Bernd Kirchhoff, Neumunster (DE)

(73) Assignee: Neumag GmbH & Co. KG, Neumunster (DE)

( * ) Notice: Subject to any disclaimer, the term of this patent is extended or adjusted under 35 U.S.C. 154(b) by 254 days.

(21) Appl. No.: 10/226,132

(22) Filed: Aug. 21, 2002

(65) Prior Publication Data

US 2003/0068394 A1 Apr. 10, 2003

(30) Foreign Application Priority Data

Sep. 11, 2001 (DE) ..... 101 44 553

(51) Int. Cl.[7] ..... D01D 5/20

(52) U.S. Cl. ..... 425/66; 425/382.2; 425/76; 425/94; 425/104; 425/377; 425/DIG. 115; 425/DIG. 17; 28/220; 28/247; 28/258

(58) Field of Search ..... 425/66, DIG. 17, 425/72.2, 76, 94, 104, 382.2, 464, 377, DIG. 115; 28/220, 219, 247, 258

(56) References Cited

U.S. PATENT DOCUMENTS 3,801,242 A 4/1974 Bauch ..... 425/66
4,023,743 A * 5/1977 Schippers ..... 242/473.6
4,043,718 A * 8/1977 Takenaka et al. ..... 425/72.2
4,825,517 A 5/1989 Hagler ..... 28/220
5,755,086 A 5/1998 Halbheer et al. ..... 57/351
6,210,143 B1 * 4/2001 Takagi et al. ..... 425/142

FOREIGN PATENT DOCUMENTS

| | | |
|---|---|---|
| DE | 199 29 817 A1 | 6/1999 |
| EP | 0 718 424 B1 | 11/1995 |
| EP | 1 022 364 A1 | 7/2000 |

* cited by examiner

*Primary Examiner*—Joseph S. Del Sole
(74) *Attorney, Agent, or Firm*—Smith Moore LLP

(57) ABSTRACT

A spinning-drawing-texturing machine for producing crimped threads is described, comprising a spinning device, a drawing device, a texturing device, and a take-up device. A plurality of threads spun by the spinning device is assigned to the drawing device, the texturing device, and the take-up device. According to the present invention, the drawing device and the texturing device are arranged in a processing module and the take-up device in a winding module underneath the spinning device. The processing module and the winding module are erected side by side and form one long side of the machine. This ensures a configuration divided by functional groups, which facilitates operation and increases operational reliability.

10 Claims, 3 Drawing Sheets

SPINNING-DRAWING-TEXTURING MACHINE

BACKGROUND OF THE INVENTION

The present invention relates to a spinning-drawing-texturing machine for producing crimped threads.

Spinning-drawing-texturing machines for producing crimped threads are generally known in the art and are essentially used for producing carpet yarns. To this end, the spinning-drawing-texturing machine comprises a spinning device, a drawing device, a texturing device, and a take-up device. A plurality of parallel threads is spun from a polymer melt, jointly drawn, and textured in parallel. The threads, which are crimped after texturing, are wound up in parallel by the take-up device. For this purpose, the spinning device, the drawing device, the texturing device, and the take-up device are arranged vertically one underneath the other. Such machines have the drawback, however, that the threads must be guided over several tiers for spreading.

European publication EP 0 718 424 A1 discloses a spinning-drawing-texturing machine which remedies the drawback of poor threading means by combining the drawing device, texturing device and take-up device in a single machine unit for texturing and winding up a single thread. A plurality of such machine units is arranged side by side. This type of drawing-texturing machine, however, has the general drawback that a corresponding number of machine units is required to process a plurality of threads in parallel. Furthermore, the integration of the functional components into a single machine unit has the disadvantage that mutual influences, for instance in case of a spool change, are unavoidable.

Accordingly, there is a need in the art for a spinning-drawing-texturing machine for producing crimped threads, which has a user-friendly compact structure.

There is a further need in the art to make the processing and take-up of the threads as flexible as possible.

BRIEF SUMMARY OF THE INVENTION

These objects are attained by a spinning-drawing-texturing machine wherein the devices required for performing the essential process steps to produce the crimped threads are separated by their function and are combined into individual machine modules. Thus, the drawing device and texturing device, which are necessary to process the spun threads, together form a processing module. This processing module is arranged underneath the spinning device, such that the freshly spun threads can feed directly into the processing module for processing. After the threads have been spun and processed, they are wound onto spools. For this purpose, the take-up device is arranged in a winding module, which is erected directly adjacent to the processing module and thus forms a long side of the machine. The texturing machine according to the present invention thus has the particular advantage of a small overall height, so that the drawing device and the texturing device in the processing module as well as the take-up device in the winding module can be operated from a single level by the operator personnel. The separation into the functional groups according to the present invention provides a further advantage. Spool changes in the take-up device can be performed without significantly influencing the devices arranged in the adjacent processing module.

Another advantage of the present invention is that the threads that exit from the processing module at a close thread distance to one another can be wound up without any substantial spreading. The drawing device, texturing device and take-up device essentially form a single common control level for the processing and take-up of the threads. As a result, tension differences in the individual threads due to increased spreading can advantageously be avoided.

The present invention further provides a particularly flexible configuration of the spinning-drawing-texturing machine. Here, the take-up units of the take-up device, which are tiered one over the other, are independently driven and controlled. Each crimped thread can be individually wound onto a spool. The take-up rates are the same. A particular advantage of this embodiment is that if a thread breaks in one take-up unit, the process does not have to be interrupted, so that high machine utilization is ensured.

The take-up units can each be provided with a driven spindle, which receives the spool. To ensure continuous take-up of the threads, the take-up units can each be provided with two driven spindles that alternately receive the spool.

When crimped threads are produced, additional processing after spinning of the threads is required as a function of the yarn type. For instance, if stuffer box texturing devices are used, an additional cooling device is used to cool the compressed thread. Likewise, swirling of the threads before or after texturing may be necessary to improve cover. A further advantage of the present invention is that it is possible to integrate the additional processing devices in the processing module.

According to a preferred embodiment of the present invention, a broken-end collecting device is assigned to the take-up device to ensure that the process is not interrupted if there is a malfunction in the take-up device. This broken-end collecting device has a respective suction port upstream of each take-up unit. This ensures that the threads are continuously drawn off from the processing module even if a thread breaks in one of the take-up units.

Another advantage of the present invention is its high degree of automation. A robot is provided for thread guidance during thread spreading at the start of the process and a doffer for changing the spool in the take-up units. The robot or doffer is preferably guided so as to be displaceable along the long length of the machine to enable thread guidance from the spinning device up to the take-up unit.

A further advantage of the present invention is its high operational reliability. It also provides protection from volatile components during operation, e.g., related vapors.

BRIEF DESCRIPTION OF THE FIGURES

The present invention will now be described in greater detail, by way of example, with reference to some embodiments depicted in the figures, in which.

DETAILED DESCRIPTION OF THE PREFERRED EMBODIMENTS

Figure 1:
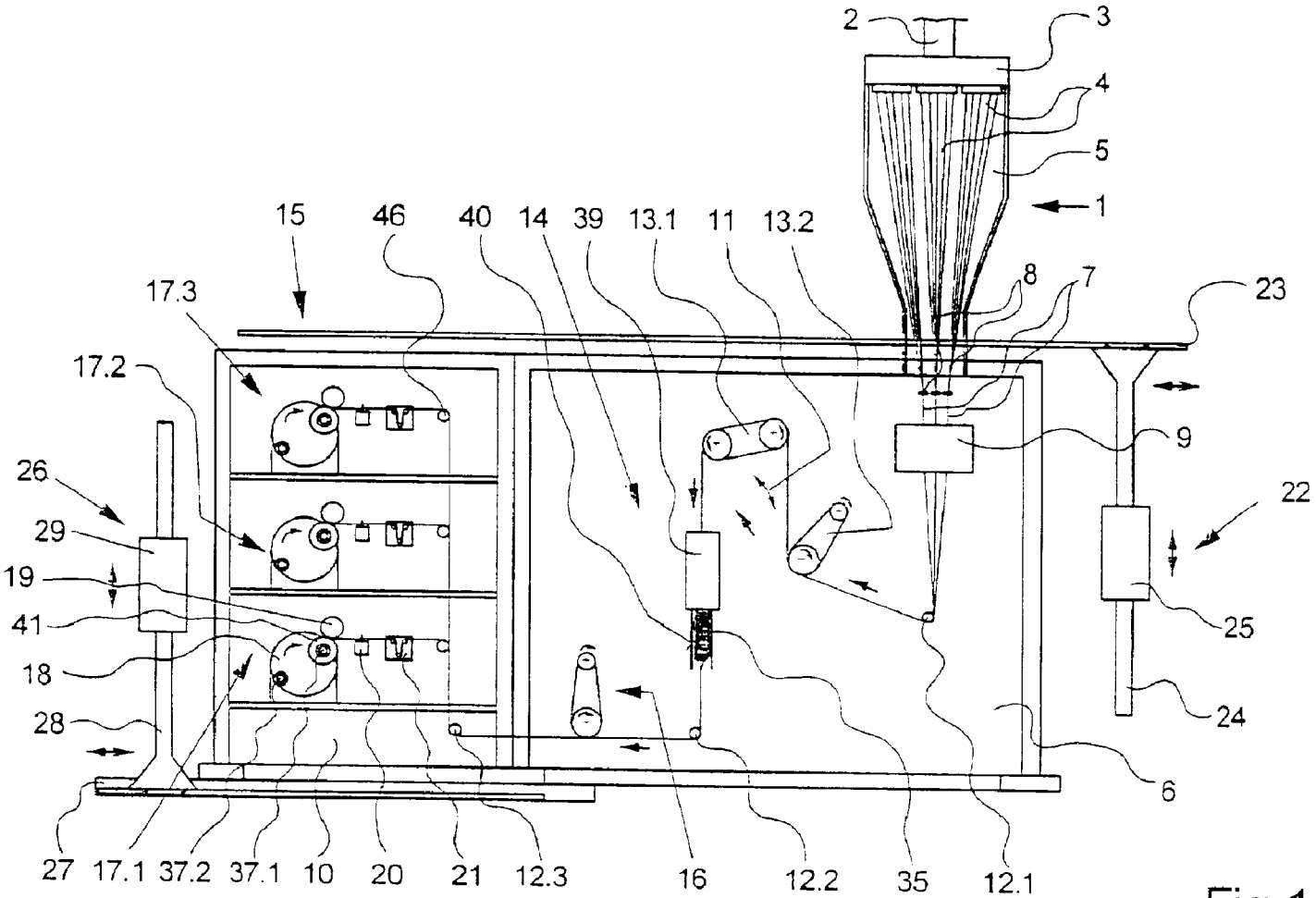
FIG. 1 is a schematic front view of a first embodiment of the inventive spinning-drawing-texturing machine of the present invention.

Unless express reference is made to one of the figures, the following description applies to both embodiments.

The spinning-drawing-texturing machine comprises a spinning device 1, which is supported in a processing module 6. The spinning device comprises a melt feed 2, a spinning beam 3, a plurality of spinnerets 4 arranged on the underside of the spinning beam 3, and a spinning chamber 5.

The processing module 6 is configured as a machine frame for carrying a drawing device 11 and a texturing device 14. A winding module 10 is erected adjacent to the processing module 6. The winding module 10 is also configured as a frame to receive a plurality of take-up units 17.1, 17.2 and 17.3 and together with the processing module 6 forms a long side 38 of the machine.

The processing module 6, in addition to the drawing device 11 and the texturing device 14, comprises a finishing device 9 assigned to the outlet of the spinning device 1, a deflection roller 12.1 arranged between finishing device 9 and drawing device 11, and a delivery device 16 arranged downstream of the texturing device 14. A plurality of thread guides 8 for forming threads 7 is assigned to finishing device 9. Finishing device 9 is advantageously coupled with a broken end collecting device and a cutting device (not depicted). The drawing device 11 is formed by two godet units 13.1 and 13.2. Godet unit 13.1 is formed, for instance, by two driven godets. Godet unit 13.2, by way of example, is depicted as a driven godet and a deflecting roller, around which the threads loop several times. The texturing device 14, which is arranged downstream of the drawing device 11 comprises a texturing nozzle 39 and a plurality of discharge pipes 40. The texturing nozzle 39 comprises a plurality of guide channels and stuffer boxes in which one thread 7 each is crimped into a compressed thread 35 (not depicted in FIG. 2). Between texturing device 14 and delivery device 16, a deflection roller 12.2 is arranged.

The take-up device 15 in winding module 10 comprises a plurality of tiered take-up units 17.1 to 17.3. Each of the take-up units 17.1 to 17.3 has a spindle carrier 18 on which two projecting spool spindles 37.1 and 37.2 are arranged. Spindle carrier 18 is rotatably supported such that the spool spindles 37.1 and 37.2 can alternately be swung into a winding position and a changing position. In the winding position, a spool 41 is wound onto winding spindle 37. For this purpose, the take-up unit 17 is provided, respectively, with a dancer arm control 21, a changing unit 20, and a contact roll 19. Dancer arm control 21 controls the drive of spool spindle 37 in such a way that the take-up speed remains constant. Spool spindle 37 can be driven either directly by a spindle drive or indirectly by a driven contact roll 19. Threads 7 are guided to the take-up units 17.1 to 17.3 in the take-up module 10 via a deflection roller 12.3 and a plurality of thread guides 46. The thread guides 46 can also be configured as a deflection roller.

In the spinning device of the embodiment of the spinning-drawing-texturing machine shown, a polymer melt is delivered to spinning device 1, e.g., by means of an extruder, and is supplied to spinning beam 3 via melt feed 2. Through spinnerets 4 the polymer melt is extruded in three filament bundles exiting side by side. Thread guides 8 combine each filament bundle into one thread 7. Threads 7 are pulled out of spinning device 1 by drawing device 11. Threads 7 are finished in finishing device 9 and are then guided to drawing device 11 via deflection rollers 12.1. The parallel threads 7 are thereby rotated by 90° in their plane of travel. In drawing device 11, threads 7 are drawn between godet units 13.1 and 13.2. For this purpose, godet units 13.1 and 13.2 are driven at a differential speed. To support the drawing process, godet units 13.1 and/or godet unit 13.2 may be designed to be heatable. After drawing, threads 7 are pulled in parallel into texturing device 14. In texturing nozzle 39, each thread 7 accumulates into a compressed thread 35. At the end of texturing device 14, the compressed threads 35 are untangled to threads 7, which are now crimped, and are guided to take-up device 15 via delivery device 16. Delivery device 16, by way of example, is configured as a godet unit, around which threads 7 loop several times.

In take-up device 15, threads 7 are distributed among the individual take-up units 17.1, 17.2 and 17.3 and on each tier are wound onto a spool 41. For this purpose, take-up units 17 can be driven either jointly via group drives or independently via individual drives. In either case, a control mechanism, in this case, for instance, a dancer arm control 21 ensures that each of the threads 7 is wound up at the same winding speed. Due to the inventive separation of the functional components, a doffer 26 for performing spool changes is assigned to winding module 10. To this end, doffer 26 is guided in a guide rail 27 parallel to the long side 38 of the machine in the area of the winding module 10. Doffer 26 is provided with a carrier 28, which is guided in guide rail 27 along the floor. A holder 29 is formed on carrier 28 and is provided with the gripper arms required to change the spool. The doffer 26 is capable of executing the entire sequence of motions, such as placing the empty bobbins, removing the full spools, and possibly also spreading the threads in the take-up unit.

Figure 2:
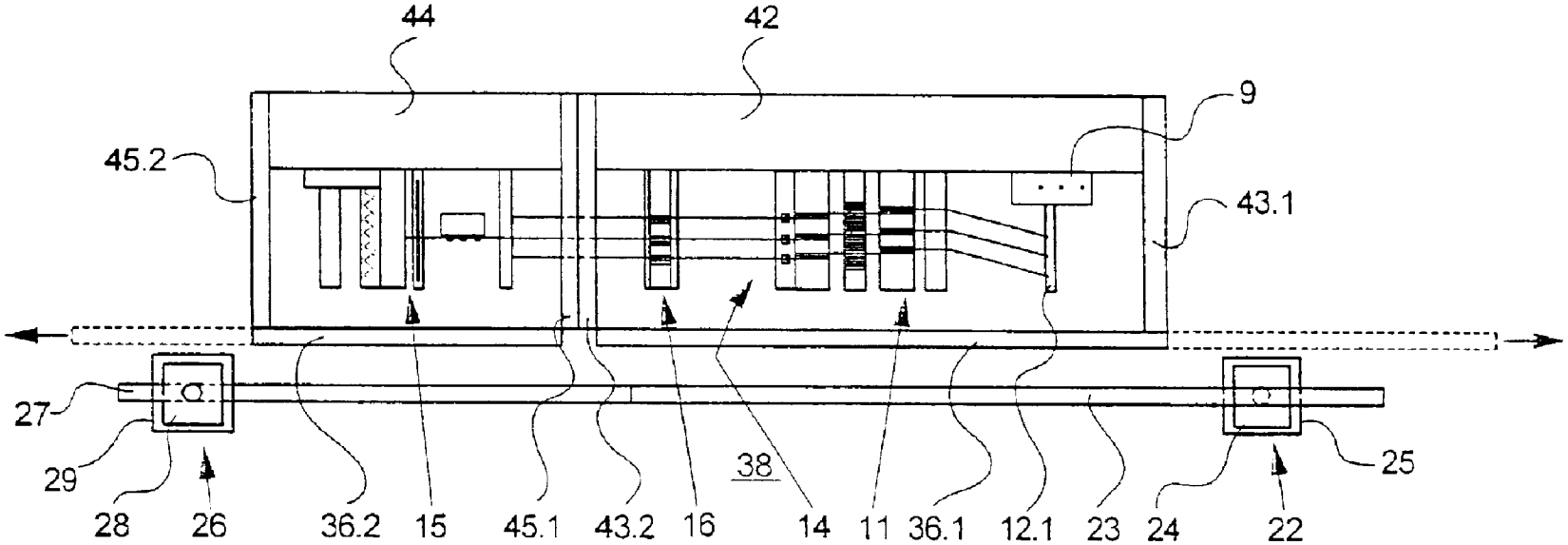
FIG. 2 is a schematic top view of the embodiment of FIG. 1.

To spread threads 7 at the start of the process, the exemplary embodiment according to FIGS. 1 and 2 comprises a robot 22, which is guided parallel to the long side 38 of the machine in a guide rail 23. Guide rail 23 is arranged above processing module 6 and winding module 10. A carrier 24, which is provided with a holder 25 that is designed to be movable, is guided in guide rail 23. Holder 25 comprises all the necessary gripper arms and drives to enable it to spread the threads.

During operation, processing devices 9, 11, 14 in processing module 6 as well as take-up device 15 in winding module 10 are shielded toward the outside. As may be seen in FIG. 2, processing module 6 is provided with a carrier 42 having sidewalls 43.1 and 43.2. Processing devices 9, 11 and 14 are arranged on carrier 42. The side walls 43.1 and 43.2 and a protective covering 36.1, which can be displaced parallel to the long side 38 of the machine, form an enclosure, which protects the processing devices 9, 11 and 14 toward the outside relative to the long side 38 of the machine. Likewise, winding module 10 is formed by a carrier 44 and sidewalls 45.1 and 45.2. Sidewalls 45.1 and 45.2, on the side opposite carrier 44, are interconnected by a protective covering 36.2, which can be moved parallel to the longitudinal side 38 of the machine. Here, too, protective covering 36.2 forms an enclosure together with sidewalls 45.1 and 45.2. Protective coverings 36.1 and 36.2 are each configured as a closed, e.g., transparent wall, which together with a top cover (not depicted) forms a complete enclosure so as to reduce, for example, dust accumulation and noise as well as to protect the operator personnel from the rotating components and to make it possible to provide air conditioning for sensitive materials.

Figure 3:
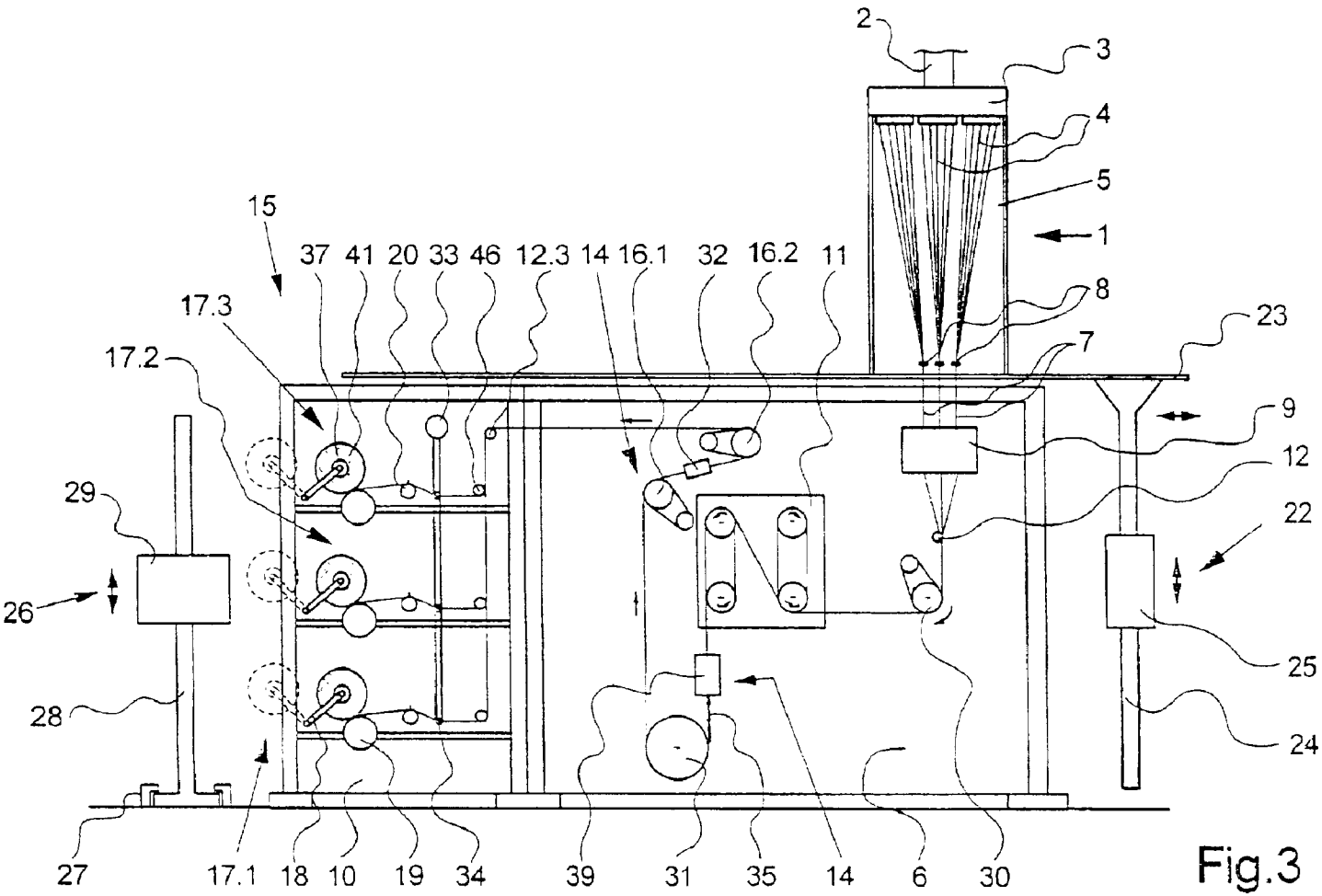
FIG. 3 is a schematic view of a second embodiment of the inventive spinning-drawing-texturing machine of the present invention.

FIG. 3 is a schematic front view of a further exemplary embodiment of the inventive spinning-drawing-texturing machine. Components with like functions are provided with identical reference numerals.

The construction of this embodiment is substantially identical to the preceding embodiment. Insofar, only the differences will be described below. For the rest, reference is made to the preceding description regarding FIGS. 1 and 2.

Underneath spinning device 1, processing module 6 and winding module 10 are erected side by side to form a long side of the machine. Arranged consecutively in the travel direction of the thread, processing module 6 comprises a finishing device 9, a deflection roller 12.1, a delivery device 30, a drawing device 11, a texturing device 14, a cooling device 31, two delivery devices 16.1 and 16.2, and a swirling device 32, which is arranged between delivery devices 16.1 and 16.2. In this embodiment, in contrast to the preceding embodiment, threads 7 are pulled from spinning device 1 by an additional delivery device 30 and are guided to the subsequent drawing device 11. The drawing device is formed by two godet units 13.1 and 13.2, each of which comprises two driven godets. Threads 4 are guided parallel to one another in several loops around the respective godet units 13.1 and 13.2. Godet units 13.1 and 13.2 are driven at a differential speed to draw the threads. After drawing, the threads are crimped in texturing device 14. For this purpose, texturing device 14 is provided with a texturing nozzle 39. Arranged downstream of texturing nozzle 39 is a cooling device 31, which is provided with side-by-side circumferential grooves, one per thread, to receive the compressed threads 35 exiting from the texturing device 14. The cooling device 31 is configured as a drum, along the circumference of which the compressed threads 35 are cooled. To untangle the compressed threads 35, threads 7 are pulled from the cooling device 31 by the downstream delivery device 16.1. Between delivery devices 16.1 and 16.2, a swirling device 32 is arranged in processing module 6. Here, the threads are swirled to increase cover. This concludes the processing of the threads. The threads are delivered to winding module 10 and are distributed among the individual take-up units 17.1, 17.2 and 17.3 of take-up device 15. The take-up units 17 each have a spindle carrier 18 with a spool spindle 37 held on the circumference of a driven contact roll 19. Spindle carriers 18 are pivotable. In front of contact roll 19, as seen in the travel direction of the thread, a changing unit 20 is provided, which receives the thread running off a thread guide 46, preferably via a deflecting roller, and guides it back and forth substantially parallel to spool 41.

Take-up device 15 is associated with a broken-end collecting device 33, which comprises a plurality of suction ports 34. One suction port 34 is assigned to each of the take-up units 17.1 to 17.3. The broken-end collecting device 33 is connected with a yarn container (not depicted). If a spool has to be changed or if a thread breaks in one of the take-up units 17.1 to 17.3, the incoming thread is guided to the broken-end collecting device 33 via the associated suction port 34 and is deposited in a yarn container. This ensures that the processing devices in processing module 6 can continue to operate without interruption. The process does not have to be turned off.

In the spinning-drawing-texturing machine shown in FIG. 3, on the side of winding module 10, a servicing passage is formed in which doffer 26 is guided. Doffer 26 is configured identically to the preceding embodiment and takes care of spool changes in take-up units 17.1 to 17.3.

Robot 22 is movably guided parallel to the long side of the machine to spread threads 7 in the processing devices of processing module 6. The configuration of robot 22 is identical to that of the preceding embodiment, so that reference can be made to the preceding description.

The exemplary embodiments depicted in FIGS. 1 to 3 are given by way of example with respect to the structure and the arrangement of the processing devices and the take-up device. For instance, all the required components in the area of thread feeding as well as godets, texturing units, cooling drum and detangling unit can be arranged in a clear layout in processing module 6. The lateral arrangement of the take-up device in the winding module results in a highly compact arrangement with an overall height that can measure less than 2 m. This ensures simple and easy service accessibility of both the processing devices and the take-up device.

Individual processing units can also be removed from, or replaced in the processing module, for instance to produce uncrimped FDY [Fully Oriented Yarn] or POY [Partially Oriented Yarn].

In the drawing devices shown in the exemplary embodiments, the number and configuration of the godets can basically be freely selected. The configuration of the drawing device depends on the production process and the overall type.

Likewise, the number of parallel-guided and processed threads is given by way of example (three threads are shown). Single threads or a plurality of threads can be guided, processed and wound without problem. To wind up the threads, the take-up units could also be formed by two winding stations, which can be alternately used to wind the thread. Single thread guidance in the take-up area produces identical take-up conditions on each take-up unit. This ensures gentle and uniform winding of the threads. The take-up units can be arranged either vertically one above the other or horizontally side by side, as a function of the number of the threads.

Robots and doffers can advantageously be used to automate the process. For instance, to spread the threads, a robot can be assigned exclusively to the processing devices of processing module 6. Such a robot is capable of performing all the required sequences of motion and spreading procedures. For this purpose, the processing devices of the processing module, e.g., the finishing device and the swirling device, can be provided with corresponding auxiliary devices. A second robot could be used spread the threads in the take-up device as well as change the spools.

What is claimed is:

1. Spinning-drawing-texturing machine for producing crimped threads comprising:

a spinning device;

a drawing device;

a texturing device; and a take-up device;

wherein a plurality of threads spun by the spinning device is assigned to the drawing device, the texturing device and the take-up device;

wherein the drawing device and the texturing device are arranged in a processing module underneath the spinning device;

wherein the take-up device is arranged in a winding module;

wherein the processing module and the winding module are arranged side by side, thereby forming a long side of the machine; and wherein a doffer is movably arranged along the long side of the machine, and wherein the doffer changes spools in the take-up units of the take-up device.

2. Spinning-drawing-texturing machine as claimed in claim 1 wherein the take-up device comprises a plurality of take-up units which are arranged in tiers, one above the other, in the winding module.

3. Spinning-drawing-texturing machine as claimed in claim 2 wherein the take-up units of the take-up device can be driven and controlled independently of one another, and wherein each of the take-up units takes up one textured thread on a spool.

4. Spinning-drawing-texturing machine as claimed in claim 3 wherein the take-up units are each provided with a spindle carrier for receiving the spool.

5. Spinning-drawing-texturing machine as claimed in claim 3 wherein the take-up units are each provided with two spool spindles, which alternately receive the spool.

6. Spinning-drawing-texturing machine as claimed in claim 2 wherein a broken-end collecting device is assigned to the take-up device in the winding module, and wherein the broken-end collecting device comprises a respective suction port arranged upstream of each take-up unit.

7. Spinning-drawing-texturing machine as claimed in claim 2 wherein the processing module comprises a plurality of holding fixtures to carry additional processing devices for processing spun threads and/or textured threads.

8. Spinning-drawing-texturing machine as claimed in claim 1 wherein the processing module comprises a plurality of holding fixtures to carry additional processing devices for processing spun threads and/or textured threads.

9. Spinning-drawing-texturing machine as claimed in claim 1, wherein a robot is movably arranged along the long side of the machine, and wherein the robot guides and spreads the threads at the start of the process.

10. Spinning-drawing-texturing machine as claimed in claim 1 wherein the processing module and/or the winding module is provided with a protective cover that is movably arranged along the long side of the machine, such that the spinning, drawing and texturing devices and/or the take-up device can be shielded toward the outside.

* * * * *

UNITED STATES PATENT AND TRADEMARK OFFICE

CERTIFICATE OF CORRECTION

PATENT NO. : 6,890,166 B2
DATED : May 10, 2005
INVENTOR(S) : Bernd Kirchhoff

It is certified that error appears in the above-identified patent and that said Letters Patent is hereby corrected as shown below:

Column 6,
Line 10, "FDY" should read -- FOY --.

Signed and Sealed this

Eighteenth Day of October, 2005

JON W. DUDAS
*Director of the United States Patent and Trademark Office*